US007063565B2

(12) United States Patent
Ward

(10) Patent No.: US 7,063,565 B2
(45) Date of Patent: Jun. 20, 2006

(54) COAXIAL CABLE CONNECTOR

(75) Inventor: Randy Ward, Cordova, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 10/846,263

(22) Filed: May 14, 2004

(65) Prior Publication Data

US 2005/0255735 A1 Nov. 17, 2005

(51) Int. Cl.
*H01R 9/05* (2006.01)

(52) U.S. Cl. ..... 439/578

(58) Field of Classification Search ..... 439/578, 439/584, 585

See application file for complete search history.

(56) References Cited

U.S. PATENT DOCUMENTS

| | | | |
|---|---|---|---|
| 1,667,485 | A | 4/1928 | MacDonald |
| 2,258,737 | A | 10/1941 | Browne |
| 2,549,647 | A | 4/1951 | Turenne |
| 3,076,168 | A | 1/1963 | Keen |
| 3,184,706 | A | 5/1965 | Atkins |
| 3,275,913 | A | 9/1966 | Blanchard et al. |
| 3,292,136 | A | 12/1966 | Somerset |
| 3,350,677 | A | 10/1967 | Daum |
| 3,355,698 | A | 11/1967 | Keller |
| 3,373,243 | A | 3/1968 | Janowiak et al. |
| 3,406,373 | A | 10/1968 | Forney, Jr. |
| 3,448,430 | A | 6/1969 | Kelly |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |
| 3,564,487 | A | 2/1971 | Upstone et al. |
| 3,629,792 | A | 12/1971 | Dorrell |
| 3,633,150 | A | 1/1972 | Swartz |
| 3,668,612 | A | 6/1972 | Nepovim |
| 3,671,922 | A | 6/1972 | Zerlin et al. |
| 3,694,792 | A | 9/1972 | Wallo |
| 3,710,005 | A | 1/1973 | French |
| 3,778,535 | A | 12/1973 | Forney, Jr. |
| 3,781,762 | A | 12/1973 | Quackenbush |
| 3,836,700 | A | 9/1974 | Niemeyer |
| 3,845,453 | A | 10/1974 | Hemmer |
| 3,846,738 | A | 11/1974 | Nepovim |

(Continued)

FOREIGN PATENT DOCUMENTS

| | | |
|---|---|---|
| DE | 47931 | 10/1888 |

(Continued)

*Primary Examiner*—Tulsidas C. Patel
*Assistant Examiner*—Harshad Patel
(74) *Attorney, Agent, or Firm*—Hoffmann & Baron, LLP

(57) ABSTRACT

A connector is provided for terminating coaxial cable. The connector includes a connector body having a cable receiving end and an opposed connection end. The connector includes a nut member, a collar, an inner post, and an axially movable locking sleeve. The annular sleeve is movable back and forth within a range between a first open position and a second closed position. In the open position, the inner post extends outwardly beyond a cable receiving end of the locking sleeve such that the post is exposed for easy insertion of the prepared end of a coaxial cable. Upon insertion of the prepared end of the coaxial cable, the annular sleeve can be moved or expanded into the closed position to allow the inserted cable to be clamped securely in the inner post and the annular sleeve of the connector body.

13 Claims, 5 Drawing Sheets

U.S. PATENT DOCUMENTS

| | | | |
|---|---|---|---|
| 3,854,003 | A | 12/1974 | Duret |
| 3,879,102 | A | 4/1975 | Horak |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,963,320 | A | 6/1976 | Spinner |
| 3,976,352 | A | 8/1976 | Spinner |
| 3,980,805 | A | 9/1976 | Lipari |
| 3,985,418 | A | 10/1976 | Spinner |
| 4,046,451 | A | 9/1977 | Juds et al. |
| 4,053,200 | A | 10/1977 | Pugner |
| 4,059,330 | A | 11/1977 | Shirey |
| 4,093,335 | A | 6/1978 | Schwartz et al. |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,156,554 | A | 5/1979 | Aujla |
| 4,165,554 | A | 8/1979 | Faget |
| 4,168,921 | A | 9/1979 | Blanchard |
| 4,225,162 | A | 9/1980 | Dola |
| 4,227,765 | A | 10/1980 | Neumann et al. |
| 4,250,348 | A | 2/1981 | Kitagawa |
| 4,280,749 | A | 7/1981 | Hemmer |
| 4,339,166 | A | 7/1982 | Dayton |
| 4,346,958 | A | 8/1982 | Blanchard |
| 4,354,721 | A | 10/1982 | Luzzi |
| 4,373,767 | A | 2/1983 | Cairns |
| 4,400,050 | A | 8/1983 | Hayward |
| 4,408,821 | A | 10/1983 | Forney, Jr. |
| 4,408,822 | A | 10/1983 | Nikitas |
| 4,421,377 | A | 12/1983 | Spinner |
| 4,444,453 | A | 4/1984 | Kirby et al. |
| 4,456,323 | A | 6/1984 | Pitcher et al. |
| 4,484,792 | A | 11/1984 | Tengler et al. |
| 4,515,427 | A | 5/1985 | Smit |
| 4,533,191 | A | 8/1985 | Blackwood |
| 4,540,231 | A | 9/1985 | Forney, Jr. |
| 4,545,637 | A | 10/1985 | Bosshard et al. |
| 4,575,274 | A | 3/1986 | Hayward |
| 4,583,811 | A | 4/1986 | McMills |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,614,390 | A | 9/1986 | Baker |
| 4,632,487 | A | 12/1986 | Wargula |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,660,921 | A | 4/1987 | Hauver |
| 4,666,229 | A | 5/1987 | Grand |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,717,355 | A | 1/1988 | Mattis |
| 4,738,009 | A | 4/1988 | Down et al. |
| 4,746,305 | A | 5/1988 | Nomura |
| 4,747,786 | A | 5/1988 | Hayashi et al. |
| 4,755,152 | A | 7/1988 | Elliot et al. |
| 4,761,146 | A | 8/1988 | Sohoel |
| 4,772,222 | A | 9/1988 | Laudig et al. |
| 4,789,355 | A | 12/1988 | Lee |
| 4,806,116 | A | 2/1989 | Ackerman |
| 4,813,886 | A | 3/1989 | Roos et al. |
| 4,834,675 | A | 5/1989 | Samchisen |
| 4,854,893 | A | 8/1989 | Morris |
| 4,857,014 | A | 8/1989 | Alf et al. |
| 4,869,679 | A | 9/1989 | Szegda |
| 4,874,331 | A | 10/1989 | Iverson |
| 4,892,275 | A | 1/1990 | Szegda |
| 4,902,246 | A | 2/1990 | Samchisen |
| 4,906,207 | A | 3/1990 | Banning et al. |
| 4,923,412 | A | 5/1990 | Morris |
| 4,925,403 | A | 5/1990 | Zorzy |
| 4,927,385 | A | 5/1990 | Cheng |
| 4,929,188 | A | 5/1990 | Lionetto et al. |
| 4,952,174 | A | 8/1990 | Sucht et al. |
| 4,957,456 | A | 9/1990 | Olson et al. |
| 4,973,265 | A | 11/1990 | Heeren |
| 4,979,911 | A | 12/1990 | Spencer |
| 4,990,104 | A | 2/1991 | Schieferly |
| 4,990,105 | A | 2/1991 | Karlovich |
| 4,990,106 | A | 2/1991 | Szegda |
| 5,002,503 | A | 3/1991 | Campbell et al. |
| 5,007,861 | A | 4/1991 | Stirling |
| 5,021,010 | A | 6/1991 | Wright |
| 5,024,660 | A | 6/1991 | Ming-Hwa |
| 5,037,328 | A | 8/1991 | Karlovich |
| 5,062,804 | A | 11/1991 | Jamet et al. |
| 5,066,248 | A | 11/1991 | Gaver, Jr. et al. |
| 5,073,129 | A | 12/1991 | Szegda |
| 5,083,943 | A | 1/1992 | Tarrant |
| 5,120,260 | A | 6/1992 | Jackson |
| 5,127,853 | A | 7/1992 | McMills et al. |
| 5,131,862 | A | 7/1992 | Gershfeld |
| 5,141,451 | A | 8/1992 | Down |
| 5,161,993 | A | 11/1992 | Leibfried, Jr. |
| 5,195,906 | A | 3/1993 | Szegda |
| 5,205,761 | A | 4/1993 | Nilsson |
| 5,207,602 | A | 5/1993 | McMills et al. |
| 5,217,391 | A | 6/1993 | Fisher, Jr. |
| 5,217,393 | A | 6/1993 | Del Negro et al. |
| 5,269,701 | A | 12/1993 | Leibfried, Jr. |
| 5,283,853 | A | 2/1994 | Szegda |
| 5,284,449 | A | 2/1994 | Vaccaro |
| 5,295,864 | A | 3/1994 | Birch et al. |
| 5,316,494 | A | 5/1994 | Flanagan et al. |
| 5,338,225 | A | 8/1994 | Jacobsen et al. |
| 5,342,218 | A | 8/1994 | McMills et al. |
| 5,354,217 | A | 10/1994 | Gabel et al. |
| 5,371,819 | A | 12/1994 | Szegda |
| 5,371,821 | A | 12/1994 | Szegda |
| 5,371,827 | A | 12/1994 | Szegda |
| 5,393,244 | A | 2/1995 | Szegda |
| 5,431,583 | A | 7/1995 | Szegda |
| 5,435,745 | A | 7/1995 | Booth |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A * | 11/1995 | Szegda ..... 439/578 |
| 5,494,454 | A | 2/1996 | Johnsen |
| 5,501,616 | A | 3/1996 | Holliday |
| 5,525,076 | A | 6/1996 | Down |
| 5,542,861 | A | 8/1996 | Anhalt et al. |
| 5,548,088 | A | 8/1996 | Gray et al. |
| 5,571,028 | A | 11/1996 | Szegda |
| 5,586,910 | A | 12/1996 | Del Negro et al. |
| 5,598,132 | A | 1/1997 | Stabile |
| 5,607,325 | A | 3/1997 | Toma |
| 5,620,339 | A | 4/1997 | Gray et al. |
| 5,632,651 | A | 5/1997 | Szegda |
| 5,651,699 | A | 7/1997 | Holliday |
| 5,667,405 | A | 9/1997 | Holliday |
| 5,863,220 | A | 1/1999 | Holliday |

| | | | | |
|---|---|---|---|---|
| 5,879,191 | A | 3/1999 | Burris | |
| 5,967,852 | A | 10/1999 | Follingstad et al. | |
| 5,975,951 | A | 11/1999 | Burris et al. | |
| 5,997,350 | A | 12/1999 | Burris et al. | |
| 6,032,358 | A | 3/2000 | Wild | |
| 6,089,913 | A | 7/2000 | Holliday | |
| 6,146,197 | A | 11/2000 | Holliday et al. | |
| 6,231,085 | B1 | 5/2001 | Olson | |
| 6,241,553 | B1 | 6/2001 | Hsia | |
| D458,904 | S | 6/2002 | Montena | |
| D460,739 | S | 7/2002 | Fox | |
| D460,740 | S | 7/2002 | Montena | |
| D460,946 | S | 7/2002 | Montena | |
| D460,947 | S | 7/2002 | Montena | |
| D460,948 | S | 7/2002 | Montena | |
| 6,425,782 | B1 | 7/2002 | Holland | |
| D461,166 | S | 8/2002 | Montena | |
| D461,167 | S | 8/2002 | Montena | |
| D461,778 | S | 8/2002 | Fox | |
| D462,058 | S | 8/2002 | Montena | |
| D462,060 | S | 8/2002 | Fox | |
| D462,327 | S | 9/2002 | Montena | |
| D468,696 | S | 1/2003 | Montena | |
| 6,530,807 | B1 * | 3/2003 | Rodrigues et al. | 439/578 |
| 6,558,194 | B1 * | 5/2003 | Montena | 439/585 |
| 6,817,869 | B1 | 11/2004 | Derenthal | |
| 6,848,940 | B1 * | 2/2005 | Montena | 439/584 |

FOREIGN PATENT DOCUMENTS

| | | | |
|---|---|---|---|
| DE | 102289 | | 7/1897 |
| DE | 1117687 | | 11/1961 |
| DE | 1 515 398 | | 11/1962 |
| DE | 1 191 880 | | 4/1965 |
| DE | 2 221 936 | | 5/1972 |
| DE | 2 225 764 | | 5/1972 |
| DE | 2 261 973 | | 12/1972 |
| DE | 32 11 008 | A1 | 10/1983 |
| EP | 0 072 104 | B1 | 2/1983 |
| EP | 0 116 157 | A1 | 8/1984 |
| EP | 0 167 738 | A2 | 1/1986 |
| EP | 0 265 276 | B1 | 4/1988 |
| FR | 2 232 846 | | 6/1973 |
| FR | 2 234 680 | | 6/1974 |
| FR | 2 462 798 | | 2/1981 |
| GB | 589697 | | 3/1945 |
| GB | 1087228 | | 10/1967 |
| GB | 1 270 846 | | 4/1972 |
| GB | 2019 665 | A | 10/1979 |
| GB | 2 079 549 | A | 1/1982 |
| GB | 2079 549 | A | 1/1982 |
| WO | 93/24973 | | 12/1993 |
| WO | 96/08854 | | 3/1996 |

* cited by examiner

COAXIAL CABLE CONNECTOR

FIELD OF THE INVENTION

The present invention relates generally to connectors for terminating coaxial cables. More particularly, the present invention relates to a coaxial cable connector having an exposed post which makes installation of a prepared coaxial cable easier for the installer.

BACKGROUND OF THE INVENTION

Coaxial cables are commonly used for transmitting signals, particularly over community antenna television (CATV) lines, also known as cable television, where they are used for transmitting television signals from a central location to television sets in subscribers' homes, businesses, or other locations.

A typical coaxial cable is generally characterized by having a centrally located electrical conductor, usually made of copper, which is surrounded by a first dielectric insulator. This dielectric insulating layer can be made of plastic or foam and forms an annular ring of substantially uniform thickness around the centrally located electric conductor. Disposed over the outer surface of the dielectric insulator is a sheath of uniformly circularly braided metallic strands, or optionally a metallic foil, or further optionally a multilayered combination of either or both. This combination of braided metallic strands and/or metallic foil serves as a second, outer conductive shield. This outer conductive shield can be bonded to the dielectric insulator, as is typically the case when metallic foil and metallic braided strands are used in combination. More specifically, the conductive metallic foil can be bonded to the dielectric insulating layer, while the layer of conductive braided metallic strands is disposed over the metallic foil, but unbonded thereto. Moreover, this conductive shield serves as a ground shield and can be applied in various thickness which are known as single, double, and triple foil cable. An outer insulative plastic jacket surrounds the conductive ground shield in order to provide protection against corrosion and weathering.

It has long been known to use connectors to terminate coaxial cables in order to connect the cables to various electronic devices such as televisions, radios and the like. In order to effectively use the cable, a connector must be attached to at least one end of the cable, forming a coaxial cable-connector assembly. The cable-connector assembly facilitates mechanical and electrical coupling of the coaxial cable to the electronic equipment, or other cable. Such a connector, in order to be practical and effective must provide a reliable mechanical and electrical connection, as well as simple to install and use. Furthermore, the coaxial cable must be first prepared for termination before forming the cable-connector assembly.

In order to prepare the coaxial cable for termination, an extent of the outer jacket from one end of the coaxial cable is stripped back and removed, exposing an extent of the metallic conductive shield, which is then folded back over the jacket. This exposes a portion of the dielectric insulator, which may be optionally covered by a sheath of metallic foil. Finally, a portion of the dielectric insulator is removed, exposing a section of the centrally located conductor, which extends outwardly from the insulator.

The method of and apparatus for the mechanical and electrical coupling of the connector to the coaxial cable has been the subject of considerable design innovation. Conventional coaxial cable connectors generally include a connector body having an inner cylindrical post, which is inserted between the insulator and the outer conductive shield. It has been known in the prior art to provide various mechanisms and innovations designed to provide greater security to the cable-connector assembly. For example, it has been known to provide a locking sleeve to secure the cable within the body of the coaxial connector.

Commonly owned U.S. Pat. No. 4,834,675 addresses this problem by providing a coaxial connector where the locking sleeve is frangibly tethered to the connector body. Prior to installation, the locking sleeve is frangibly removed from the connector body and inserted onto the prepared end of the cable. The cable is then inserted into the connector body for securement thereto. While the connector of the '675 patent reduces the risk of mishandling or loss of the connector components during shipment, upon installation the locking sleeve must still be removed from the connector body and attached to the cable separately. Thus, there is still a risk of mishandling or loss of components during installation.

U.S. Pat. No. 5,470,257 also provides a coaxial connector with a locking sleeve being inseparably coupled to a connector body. Cable termination using the connector of the '257 patent requires that the prepared coaxial cable be inserted axially through both the locking sleeve and connector body. Thereafter, the locking sleeve can be axially advanced so as to secure the cable in the connector body.

While in many installations, this form of cable termination is acceptable, it has been found that insertion of the prepared cable through both the locking sleeve and the connector body may be difficult in certain situations. As the cable installer typically works outdoors in an elevated or underground environment, it may become difficult to "blind" insert the prepared cable through the locking sleeve and into proper position around the cylindrical post of the connector body. In these situations, it would be desirable to permit the removal of the locking sleeve from the connector body so that the cable could be directly inserted into the connector body.

This problem is addressed in commonly owned U.S. Pat. No. 6,530,807, which provides a coaxial cable connector having a connector body and a locking sleeve in detachable, re-attachable snap engagement with the connector body. This design permits direct insertion of the cable through the locking sleeve and the connector body, or, optionally, removal of the locking sleeve from the connector body for subsequent separate reattachment.

In these situations where the installer needs to "blind" insert the prepared cable through the locking sleeve and into proper position around the cylindrical post of the connector body, this invention provides another viable alternative. In such situations, it would be desirable to have a connector with an inner post that is not recessed into the connector body and whose opening is clearly visible to the naked eye, even in low light, and easily accessible even by touch and feel.

It is, therefore, desirable to provide a coaxial connector with an inner post that extends past the distal end of the connector body so as to allow the installer to see the exact area in which the prepared end of the cable will be inserted. Moreover, even when working in low light, such a connector would permit the installer to feel the extended portion of the cylindrical inner post of the connector and insert the prepared end of the cable easily into the post.

SUMMARY OF THE INVENTION

It is a general object of the present invention to provide a coaxial cable connector which overcomes the limitations and drawbacks of other cable connectors known in the prior art.

It is a further object of the present invention to provide an improved cable connector which may be more easily and more reliably installed in accordance with general CATV cabling practices.

It is a further object of the present invention to provide an improved coaxial cable connector which provides reliable and positive electrical and mechanical connections of the connector to electrical instrument to which signals are to be transmitted.

It is a further object of the present invention to provide a coaxial cable connector containing a sleeve which, when in the retracted position, allows an extent of the inner post to become exposed past the connector sleeve and allow easy insertion of a prepared coaxial cable into the post.

It is another object of the present invention to provide a method of terminating a coaxial cable.

In the efficient attainment of these and other objects, the present invention provides a coaxial cable connector for installation and use with a prepared end of a coaxial cable. The connector comprises a connector body and a locking sleeve movably attached to the body. The connector body includes an attached member, a center post for engaging the center conductor and surrounding insulator of the prepared end of the coaxial cable and a collar rotatably coupled to the nut. The locking sleeve is positioned with respect to the connector body such that the post extends outwardly beyond a cable receiving end of the locking sleeve and unencumbered thereby permitting physical and visual access to the post for receiving an end of a prepared coaxial cable. The locking sleeve is then moved to a closed or locked position in which the post is substantially covered by the sleeve. Stated differently, the locking sleeve is expanded, i.e., moved in a direction away from the attachment means to a closed position.

In its method aspect, the present invention provides for the termination of a coaxial cable with a connector. The method provides for inserting a prepared end of a coaxial cable into a post which extends outside the bounds of a movable sleeve. The sleeve is then moved in an axial direction away from the nut member to lock the cable within the connector.

DETAILED DESCRIPTION OF THE PREFERRED EMBODIMENTS

Figure 1:
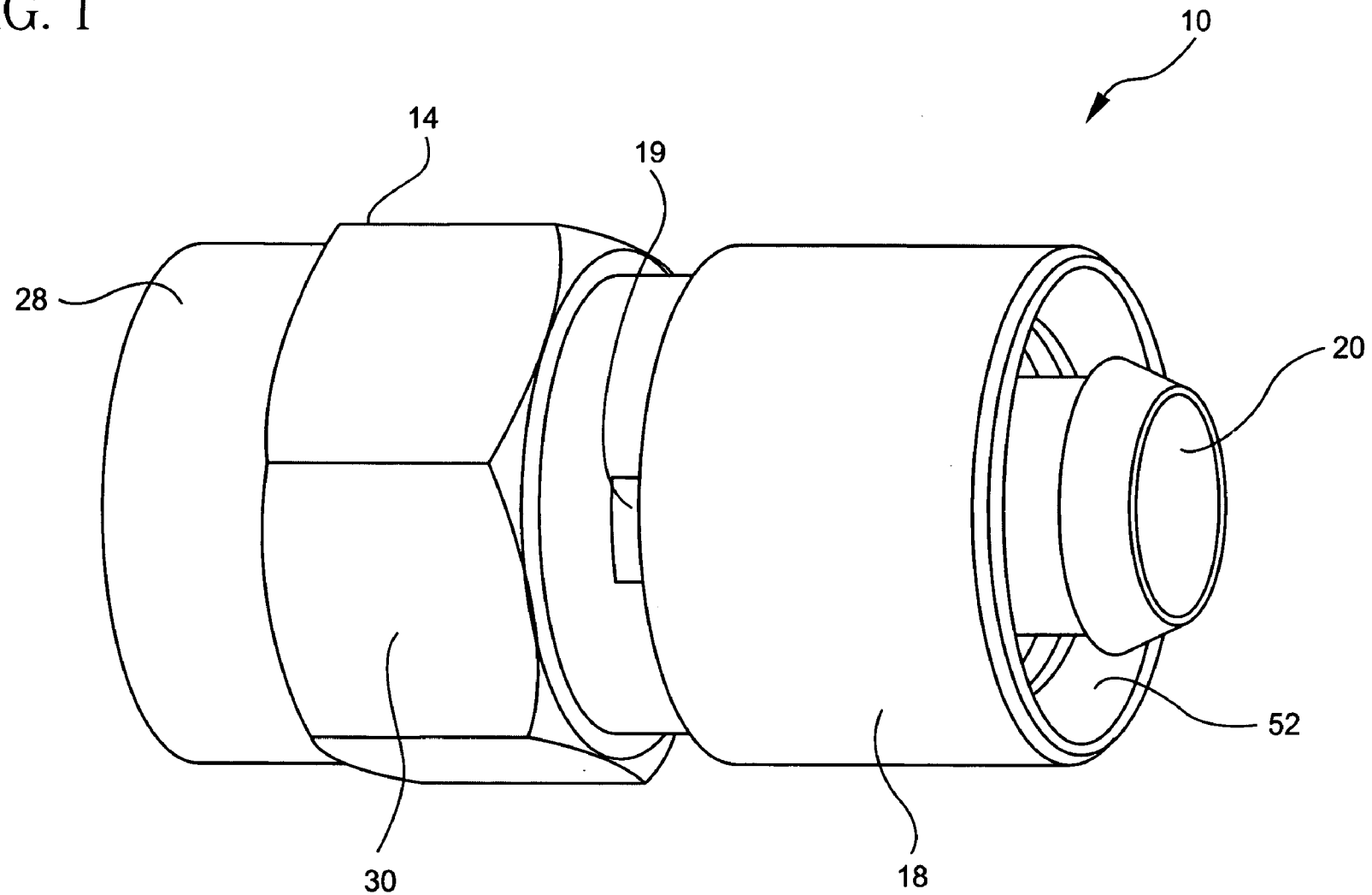
FIG. 1 illustrates a side perspective view of the coaxial connector of the present invention with the locking sleeve in the open position exposing the inner post.

A coaxial cable expansion drop connector 10 includes a connector body 12 having an attachment means in the form of an annular nut 14 rotatably coupled thereto for providing mechanical attachment of the connector to an external device and an annular locking sleeve 18. Connector body 12 is an elongate, generally cylindrical conductive member typically formed of metal, preferably brass. Connector body 12 includes an attachment member or nut member 14 and an annular collar member 16 coupled thereto. Connector body 12 also includes an inner post 20 which is defined by a distal open end 22, a proximal open end 24, and a hollow cylindrical interior 26.

Annular nut member 14 of the connector defines a generally cylindrical interior space. Particularly, nut member includes and annular end portion 28 and a generally cylindrical body portion 30. The annular end portion 28 includes an internally threaded end extent adapted to receive a threaded interface connector to electronically and mechanically integrate the connector-cable combination to the electronic device with which transmission of the signals is to be exchanged.

In an embodiment of the invention, generally cylindrical body portion 30 of annular nut 14 defines an exterior containing flat surfaces arranged as a hexagon about the longitudinal central axis. The hexagonal formation enables the installer to mechanically tighten the nut onto a receiving member of an electronic device by suitable wrenches. Alternatively, the hex formations allow the installer to grip the nut without the aid of wrenches and manually tighten the nut onto the receiving member of the electronic device. The body portion 30 may also be formed with a knurled outer surface to permit the installer to grip the nut without the use of wrenches, while manually tightening the nut about the receiving member of the electronic equipment.

Figure 3:
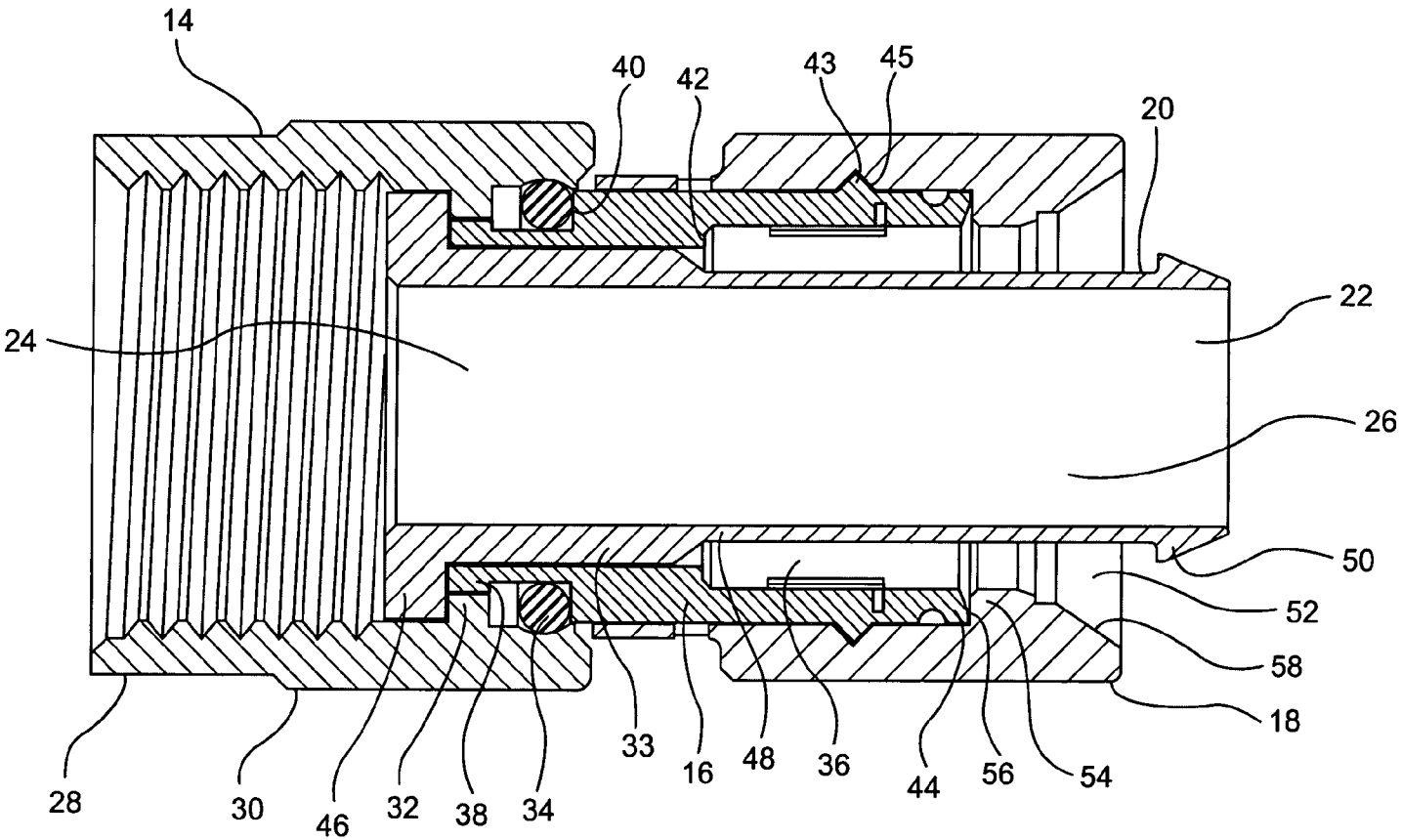
FIG. 3 is a longitudinal cross-sectional view of the connector of FIG. 1 with the locking sleeve in the open position.
Figure 4:
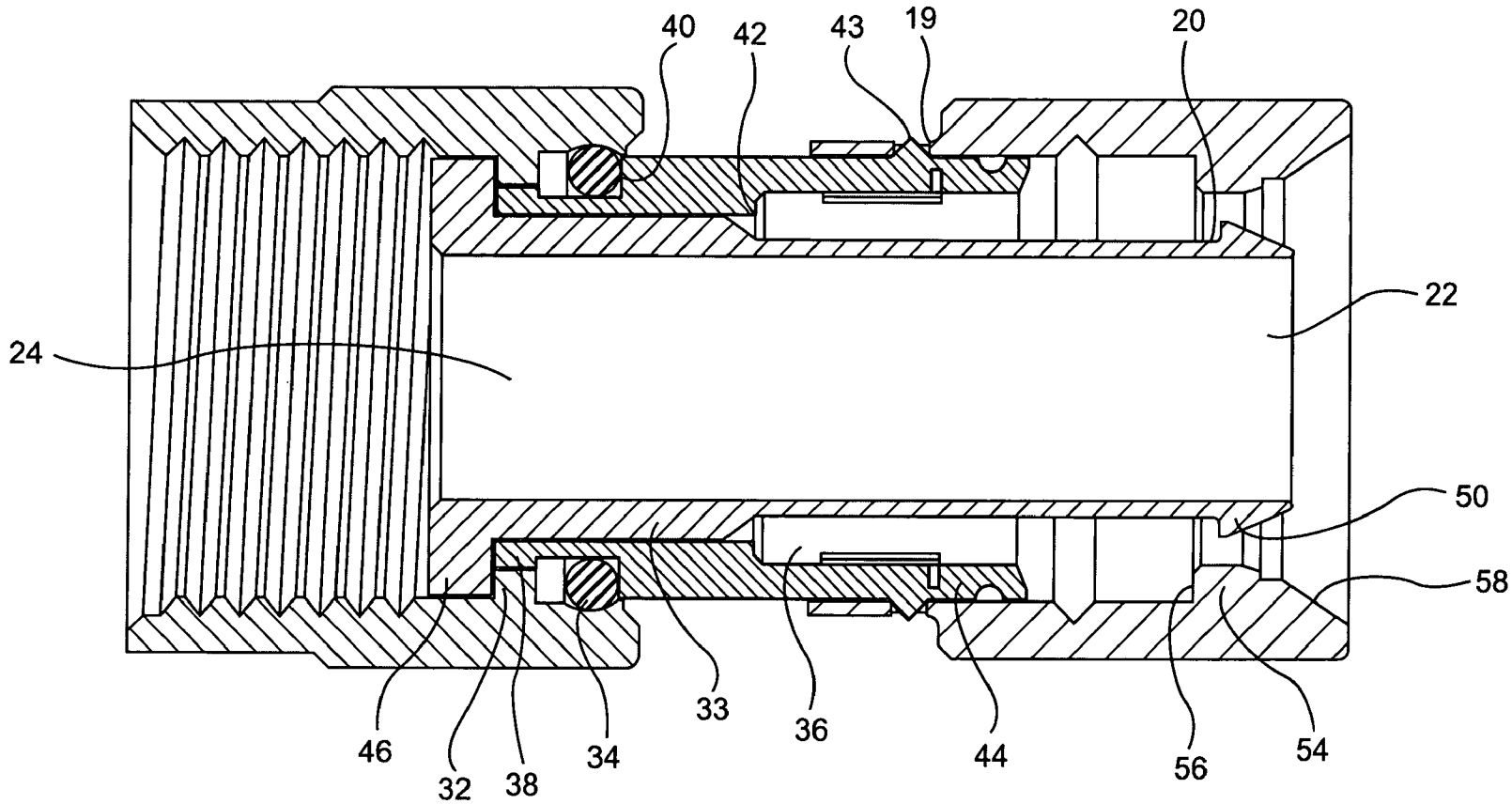
FIG. 4 is a longitudinal cross-sectional view of the connector of FIG. 2 with the locking sleeve in the closed position.

As shown in FIGS. 3 and 4, body portion 30 of annular nut 14 includes an internal annular ridge 32 defining a secondary bore, which is dimensioned to receive and rotatably engage a flanged portion 46 of the inner post 20 and a proximal end of the collar 38. A resilient sealing O-ring 34 is preferably positioned immediately distal to the internal annular ridge at the rotatable juncture thereof to provide a water-resistant seal thereat.

The collar 16 is formed to have a substantially tubular configuration. Collar 16 defines an annular chamber 36 within which a base portion 33 of the inner post 20 is located. The proximal end 38 of the tubular collar 16 provides further anchoring of the flanged portion 46 of inner post 20 into annular nut 14. Adjacent to O-ring 34, collar 16 increases in thickness to form a first outer shoulder 40. An inner shoulder 42 is provided to create a space for receiving the cable braid and outer jacket of a prepared coaxial cable. Outer shoulder 40 serves to anchor O-ring 34 in position between said outer shoulder 40 and internal annular ridge 32 of body portion 30 of annular nut 14. Accordingly, the configuration of annular ridge—O-ring—outer shoulder provides a seal at the rotatable juncture of the annular nut and the collar. As explained below, distal end 44 of collar 16 resides in integral cooperation with annular locking sleeve 18 to form annular chamber 36. Furthermore, outer surface of collar 16 contains annular rib 43 near its distal end. Annular rib 43 of collar 16 is operatively integrated with groove 45 in the internal surface of locking sleeve 18 to maintain locking sleeve in open position until it is forcibly closed using an appropriate tool, after insertion of prepared end of coaxial cable. When locking sleeve is forcibly pushed in the closed position, annular rib 43 is cooperatively coupled within through hole 19 of locking sleeve 18 to maintain locking sleeve in closed position.

Interposed within tubular collar member 16 is inner post 20. Inner post 20 is illustrated in cross section in FIGS. 3 and 4. Inner post 20 is defined by a distal open end 22, a proximal open end 24, and a hollow cylindrical interior 26. Inner post has a diameter suitable for and sized to receive the center conductor and dielectric insulator of the prepared end of a coaxial cable. Inner post 20 is fabricated to include an annular flange 46 at its proximal open end portion 24. Annular flange 46 couples inner post 20 to annular nut 14 via a press-fit configuration. From its proximal open end 24, inner post 20 continues as a distally projecting barrel portion 48, which defines its hollow cylindrical interior 26. Projecting barrel portion 48 ends at distal open end 22 in a raised barb 50, which tapers outwardly from the distal open end 22 to a flattened portion.

The outer surface of inner post 20 and inner surface of collar 16 define an annular chamber 36 around inner post. Thus, both inner post 20 and annular chamber 36 include openings at their respective distal ends. Annular chamber 36 is closed at its proximal end by inner shoulder 42 of collar 16 cooperating with a step formed on the exterior of post 20. Annular chamber 36 is sized to accommodate insulative jacket 62 and conductive shield 64 of the prepared end of a coaxial cable 60. Alternatively, the post may be modified so that the post and collar are formed as one piece. In such an embodiment, the post would have one end coupled to the attachment member and a second end including the center post as well as an extended portion which forms the chamber 36. Accordingly, one component of the connector body may be eliminated to reduce manufacturing costs.

Figure 2:
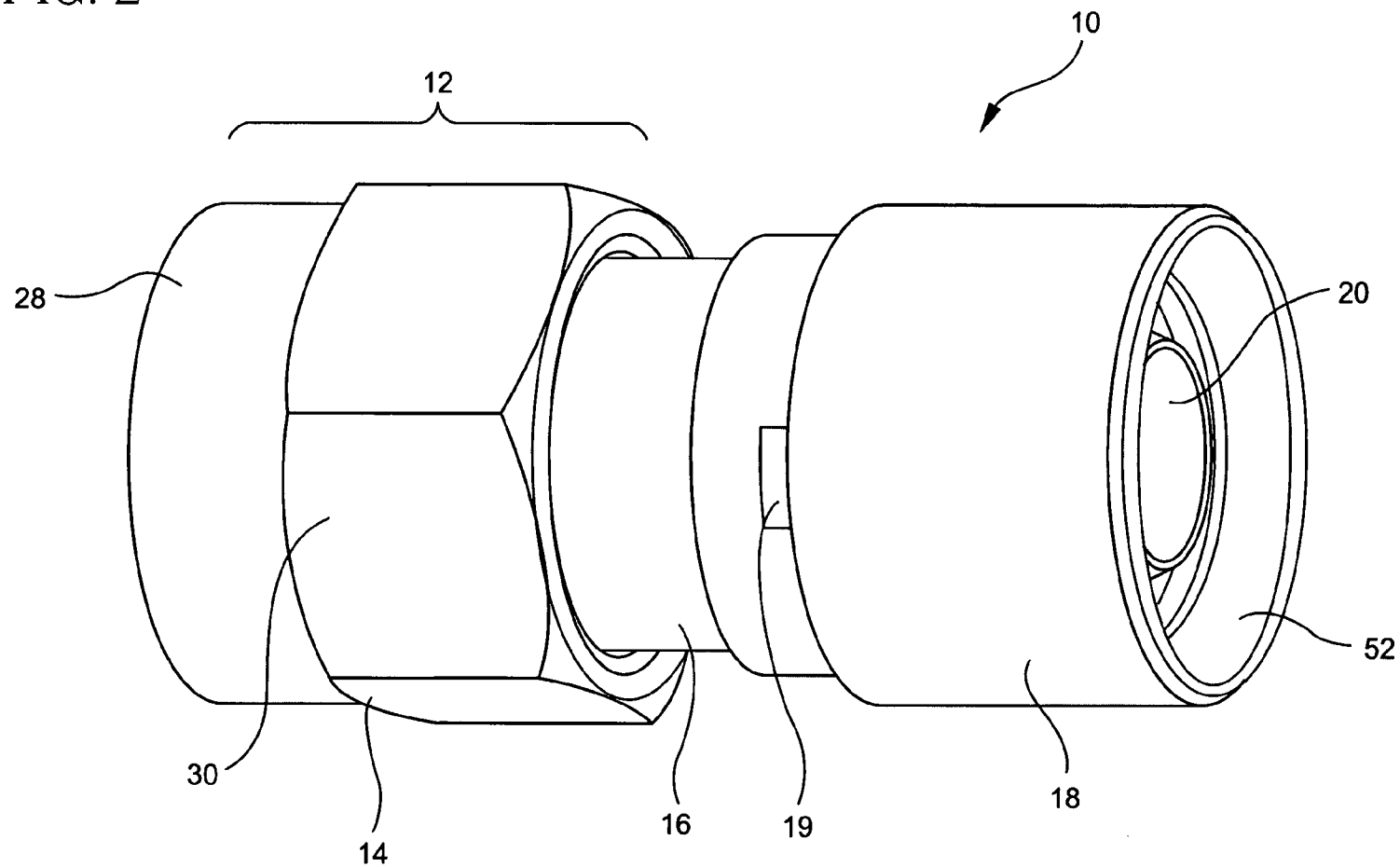
FIG. 2 illustrates a side perspective view of the coaxial connector of the present invention with the locking sleeve in the closed position.

Annular locking sleeve 18 is a generally cylindrical member typically formed of metal or plastic, which includes a distal end 52 through which the prepared cable end 60 may be inserted. Annular locking sleeve 18 cooperates in a radially spaced relationship with inner post 20 and collar 16 to further define annular chamber 36 surrounding inner post 20. Furthermore, connector 10 is designed such that annular locking sleeve 18 and collar member 16 are coupled in a manner allowing limited axial movement of annular locking sleeve 18 along a longitudinal central axis of the connector as illustrated by arrow A in FIGS. 1 and 2, between a first "open" position, shown in FIG. 1, and a second "closed" position, shown in FIG. 2.

Figure 5:
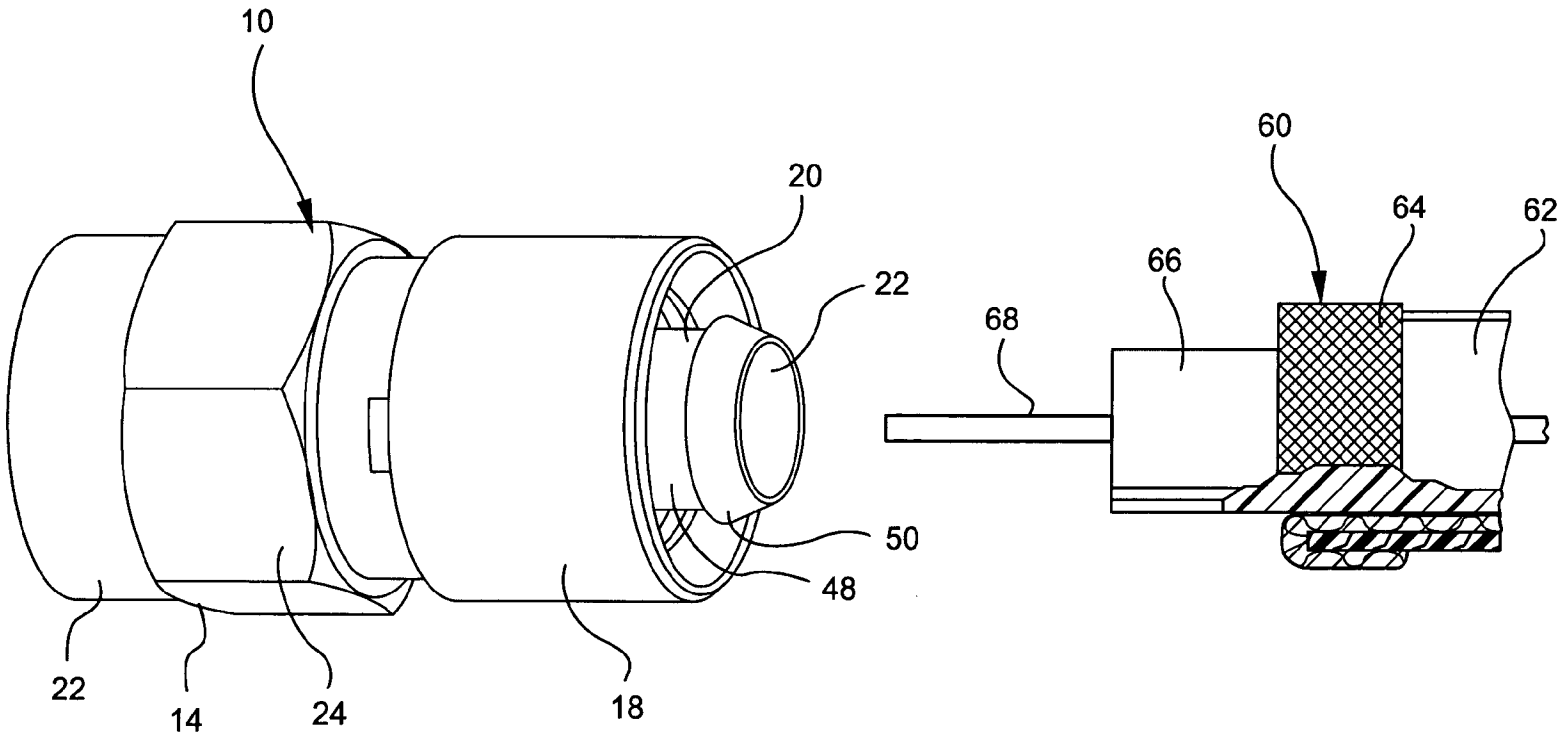
FIG. 5 is a side perspective view of the termination of a prepared coaxial cable in relation with the connector of the present invention with the annular sleeve in the open position.

Distal end 52 of annular sleeve 18 includes an inwardly directed annular rib 54. Rib 54 is defined by a proximally facing perpendicular wall 56 and a distally facing ramped surface 58. When in the open position, as illustrated in FIG. 5, annular locking sleeve 18 allows a portion of inner post 20 to extend past distal end 52 of annular sleeve 18. The open configuration in which inner post 20 extends unencumbered by the locking sleeve 18 permits easy and direct insertion of the appropriately prepared end of coaxial cable 60 into barrel 48 of inner post 20, with the central conductor 68 and insulator 66 of prepared end of cable 60 being received in inner post 20, and outer conductive shield 64 and insulative jacket 62 residing on an exterior surface of the post within the annular chamber 36. When shifted to the second or closed position, as in FIG. 4, rib 54 of annular sleeve 18 acts in concert with raised barb 50 of inner post 20 to grip and firmly clamp conductive shield 64 and insulative jacket 62 of the prepared end of cable 60 in annular chamber 36 thereby locking the cable into the connector.

Coaxial cable 60 is prepared in conventional fashion for termination, by stripping back jacket 62 and exposing an extent of shield 64. A portion of insulator 66 extends therefrom with an extent of central conductor 68 extending from insulator 66.

Prepared end of coaxial cable 60 may be inserted into connector 10 in the following manner. With annular sleeve 18 in a first "open" position, prepared end of cable 60 is inserted directly through distal open end 22 of barrel 46 of inner post 20. The innovative aspect of this technique resides in the fact that the installer no longer needs to maneuver the prepared end of the cable 60 into the annular locking sleeve 18 before ultimately introducing the central conductor 68 and insulator 64 into the inner post 20. Unlike the prior art, the post is not hidden or encompassed within the locking sleeve. Instead, distal open end 22, raised barb 50, and an extent of barrel 48 of inner post 20 are clearly visible allowing the installer to easily insert the prepared end of the cable 60 into the inner post 20 and visually assure that the cable has been properly inserted.

Once the prepared end of cable 60 is properly inserted, annular locking sleeve 18 may be moved from the first "open" position, to a second "closed" position by sliding annular locking sleeve 18 in a direction away from the nut member 14, i.e., expanding the connector components to lock the cable within the connector. The connector may also include a cooperating detent structure, such as rib 43 on the external surface of collar 16 and groove 45 in the internal surface of locking sleeve 18, to movably retain the locking sleeve in the "open" position. Thus, locking sleeve 18 may be maintained in the "open" position by the cooperative coupling of annular rib 43 of collar 16 and groove 45 of locking sleeve 18. In the second "closed" position, insulative jacket 62 and conductive shield 64 of prepared end of cable 60 become compressively clamped within annular chamber 36 between inner post 20 and collar 16. A suitable tool, such as a pair of expansion pliers, may be used to effect the movement or expansion of annular locking sleeve 18 into the second "closed" position. Likewise, the locking sleeve and collar may include a cooperating detent structure to lock or retain the locking sleeve in the "closed" position. As illustrated, the locking sleeve 18 includes a through hole or window 19 for receiving a rib 44 located at the end of collar 16. Those skilled in the art will appreciate that the cooperating detent structure may take many forms such as grooves and ribs having circular cross-sections or ramped cross-sections and flats to lockingly engage so that the sleeve cannot be opened once locked into the closed position.

As may be appreciated, proper insertion of cable 60 into connector body 12 requires that the cable be inserted in such a manner that the barrel extension 48 of inner post 20 becomes resident between insulator 66 and conductive shield 64 of prepared end of cable 60. In certain installation settings, the installer may not have clear and convenient access when terminating cable 60. Moreover, insertion may be rendered difficult by poor cable preparation, which may result in a frayed end. Therefore, it may be difficult for the installer to blindly insert the cable 60 through the annular sleeve 14 and into inner post 20 of connector body 12. The present invention overcomes these difficulties by providing a visibly open and extent of the inner post 20 in the "open" or insertion position so that the cable may be directly inserted into distal open end 22 of inner post 20. Annular locking sleeve 18 can then be moved or axially expanded to the second "closed" position, thereby locking the cable within the connector. This technique easily assures that barrel 48 of inner post 20 is inserted between insulator 66 and conductive shield 64.

Although the illustrative embodiment so of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed:

1. A coaxial cable connector comprising:

a connector body having a cable receiving end and an opposed connection end, said connector body including an attachment member having a first end adapted to be connected to an electronic device and a second end opposite the first end, and a tubular post having a first end adapted to receive a prepared end of a coaxial cable and an opposing second end fitted within the second end of the attachment member; and a locking sleeve movably coupled to the connector body having a cable receiving end, said locking sleeve being movable with respect to said tubular post, wherein the first end of the post extends a distance outwardly from the cable receiving end of the locking sleeve in an open position, wherein the prepared end of a coaxial cable can be inserted into the connector, and the locking sleeve substantially covers said post in a closed position, wherein the prepared end of a coaxial cable is fixed between said post and said locking sleeve.

2. A coaxial cable connector comprising:

a connector body having a cable receiving end and an opposed connection end, said connector body including an attachment member having a first end adapted to be connected to an electronic device and a second end opposite the first end, and a tubular post having a first end adapted to receive a prepared end of a coaxial cable and an opposing second end fitted within the second end of the attachment member; and a locking sleeve movably coupled to the connector body having a cable receiving end, wherein the first end of the post extends a distance outwardly from the cable receiving end of the locking sleeve in an open position, wherein the prepared end of a coaxial cable can be inserted into the connector, and the locking sleeve substantially covers said post in a closed position, wherein the prepared end of a coaxial cable is fixed between said post and said locking sleeve, and wherein said locking sleeve is movable to the closed position by moving the locking sleeve in an axial direction away from the attachment member.

3. A coaxial cable connector comprising:

a connector body having a cable receiving end and an opposed connection end, said connector body including an attachment member having a first end adapted to be connected to an electronic device and a second end opposite the first end, and a tubular post having a first end adapted to receive a prepared end of a coaxial cable and an opposing second end fitted within the second end of the attachment member; and a locking sleeve movably coupled to the connector body having a cable receiving end, wherein the first end of the post extends a distance outwardly from the cable receiving end of the locking sleeve in an open position, wherein the prepared end of a coaxial cable can be inserted into the connector, and the locking sleeve substantially covers said post in a closed position, wherein the prepared end of a coaxial cable is fixed between said post and said locking sleeve, and wherein said connector body further includes a collar coupled to the tubular post, said collar including an external surface upon which the locking sleeve is guided when said locking sleeve is moved.

4. A coaxial cable connector as defined in claim 3, wherein said collar is made of metal or plastic.

5. A coaxial cable connector as defined in claim 3, wherein said collar inner surface of said collar and an outer surface of said tubular post form a chamber for receiving the braid and outer jacket of a prepared coaxial cable.

6. A coaxial cable connector as defined in claim 1, wherein a prepared coaxial cable is locked into the connector by compression between the locking sleeve and post.

7. A coaxial cable connector as defined in claim 1, wherein said connector body and locking sleeve include cooperating structures to lock the locking sleeve in the first open position.

8. A coaxial cable connector as defined in claim 1, wherein the connector body and locking sleeve include cooperating structures to lock the locking sleeve in the second closed position.

9. A coaxial cable connector as defined in claim 1, wherein the locking sleeve is made of metal or plastic.

10. A connector for coupling an end of a coaxial cable to a threaded part, the coaxial cable having a center conductor surrounded by a dielectric, the dielectric being surrounded by a conductive sheath, and the conductive sheath being surrounded by an insulative outer jacket, said connector comprising:

a tubular post having a first end adapted to receive a prepared end of the coaxial cable such that the dielectric is housed within the post and the conductive sheath and outer jacket reside on an outer surface of said post, said post having an opposing second end;

an attachment member having a first end for rotatably engaging the second end of the post and having an opposing second end with an internally threaded bore for threadedly engaging the threaded part;

a cylindrical collar having a first end coupled with the post and attachment member and a second end having an inner diameter radially spaced from an outer diameter of the post to form a chamber therebetween for receiving the cable jacket and conductive sheath; and a locking sleeve having a first end movably coupled to the collar and a second end having a cable receiving opening, wherein the first end of the post extends beyond the locking sleeve first end in a first cable insertion position, the locking sleeve being movable in a direction away from the attachment member to a second locked position whereby the cable is compressed between an inner surface of the locking sleeve and an outer surface of the post to secure the cable in the connector.

11. A coaxial connector as defined in claim 10, wherein the collar and locking sleeve include cooperating structures to lock the sleeve in the locked position.

12. A coaxial connector as defined in claim 10, wherein the collar and locking sleeve include cooperating detent structures to releasably retain the locking sleeve in the cable insertion position.

13. A method of terminating a prepared end of coaxial cable in a coaxial cable connector, wherein the connector includes a connector body having a cable receiving end and an opposed connector end, the body including an attachment member having a first end adapted to be connected to an electronic device and a second end opposite the first end and a tubular post having a first end adapted to receive the prepared end of the coaxial cable and an opposing second end coupled to the attachment member, the connector further including a locking sleeve movably coupled to the connector body, the method comprising the steps of:

providing an unencumbered cable receiving end of the post whereby an end portion of said post extends beyond a cable receiving end of said locking sleeve;

inserting said prepared cable into the unencumbered cable receiving end of the post;

moving said locking sleeve axially along said connector body in a direction opposite from the attachment member and toward the inserted coaxial cable thereby compressing a jacket of the prepared cable between an interior surface of the locking sleeve and an exterior surface of said post to secure the cable within the connector.

* * * * *